US009296234B2

(12) United States Patent
Iwaya et al.

(10) Patent No.: US 9,296,234 B2
(45) Date of Patent: Mar. 29, 2016

(54) RECORDING APPARATUS AND ASSEMBLING METHOD OF COVER

(71) Applicant: SEIKO EPSON CORPORATION, Tokyo (JP)

(72) Inventors: Satoshi Iwaya, Ina (JP); Yuto Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/636,615

(22) Filed: Mar. 3, 2015

(65) Prior Publication Data

US 2015/0258826 A1 Sep. 17, 2015

(30) Foreign Application Priority Data

Mar. 14, 2014 (JP) ..... 2014-051450

(51) Int. Cl.
*B41J 29/02* (2006.01)

(52) U.S. Cl.
CPC ..... *B41J 29/02* (2013.01); *Y10T 29/49947* (2015.01)

(58) Field of Classification Search
CPC ..... B41J 2/17513; B41J 2/1752; B41J 29/02; B41J 29/13; B41J 29/38
USPC ..... 347/108, 109
See application file for complete search history.

(56) References Cited

U.S. PATENT DOCUMENTS

| | | | | |
|---|---|---|---|---|
| 6,783,231 | B1 * | 8/2004 | Kim | 347/108 |
| 2005/0141947 | A1 * | 6/2005 | Nishimura | 400/691 |
| 2006/0082622 | A1 * | 4/2006 | Yonekawa et al. | 347/85 |
| 2007/0229625 | A1 * | 10/2007 | Yano | 347/86 |

FOREIGN PATENT DOCUMENTS

| | | |
|---|---|---|
| JP | 2009-202346 | 9/2009 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

When a cover is assembled to a case, an access opening of the case is opened by an opening operation of the cover. A part which is close to a first end of a link is connected to the cover. A part which is close to a second end of the link is connected to a connecting portion of a decorative sheet. A second fastening portion of the decorative sheet is fastened with respect to a first fastening portion of the case (side wall forming member) by a fastening member which is inserted into the case from the access opening. At this time, even when an opening operation of the cover is restricted by the link and the access opening becomes narrower, it is possible to easily perform the fastening operation. For this reason, it is easy to perform an assembling operation of the cover with respect to the case.

7 Claims, 16 Drawing Sheets

RECORDING APPARATUS AND ASSEMBLING METHOD OF COVER

BACKGROUND

1. Technical Field

The present invention relates to a recording apparatus and an assembling method of a cover.

2. Related Art

As a recording apparatus, such as an ink jet type printer, an apparatus which performs recording by suspending and supporting a liquid holding body having a relatively large capacity outside of a housing of the apparatus, supplying of liquid, such as ink, held in the liquid holding body to a recording portion inside the housing, and ejecting the liquid onto a medium by the recording portion is known (refer to JP-A-2009-202346). In the recording apparatus, since the time and labor to move the housing and the liquid holding body separately are saved when moving the apparatus, an apparatus in which a case for storing the liquid holding body is mounted in the housing is considered.

In the case, in order to prevent malfunction in operations other than an operation related to putting in and out of the liquid holding body, and in order not to impair appearance, a cover which can be opened and closed with respect to the case is provided. Furthermore, in order to prevent the cover from bumping into an object in the periphery and becoming an obstacle when the cover is opened, a link mechanism which allows an opening operation of the cover to a certain level and restricts an opening level of the cover to be less than a predetermined level is provided. The link mechanism is provided with a link which links the case and the cover. A first end of the link is connected to one of the cover and the case. In addition, a boss is provided in the other one of the cover and the case. A mounting portion to which a second end of the link is connected is fixed to the boss.

However, the cover is assembled with respect to the case by bringing the second end of the link into contact with the mounting portion and fixing the mounting portion to the above-described boss, after bringing the first end of the link into contact with the cover or the case. However, since an opening level of the cover with respect to the case is restricted by the link mechanism when the mounting portion is fixed to the boss, an operation for fixing becomes difficult to perform and operability of an assembling operation of the cover with respect to the case deteriorates.

In addition, a problem that the above-described operability of the assembling operation of the cover deteriorates has already become a common problem of recording apparatuses in addition to the ink jet type printer. Furthermore, the above-described problem is not limited to the cover which is assembled to the case that stores the liquid holding body, and has already become a common problem in other covers which is opened and closed with respect to a main body.

SUMMARY

An advantage of some aspects of the invention is to provide a recording apparatus and an assembling method of a cover, which can make it easy to perform an assembling operation of the cover.

Hereinafter, means of the invention and operation effects thereof will be described.

There is provided a recording apparatus, including: a case which is provided on a side surface of a housing and accommodates a liquid holding body; a recording portion which is provided in the housing and ejects liquid supplied from the liquid holding body onto a medium; a cover which opens or closes an access opening of the case by an opening/closing operation; a link of which a first end portion side is connected to one of the case and the cover; a first fastening portion which is provided in the other one of the case and the cover; and a mounting portion which has a connecting portion which is connected to a second end portion side on a side opposite to the first end portion side of the link, and a second fastening portion which is fastened with the first fastening portion, and is mounted in the other one of the case and the cover. The mounting portion is mounted with respect to the other one of the case and the cover by fastening the first fastening portion and the second fastening portion by a fastening member which is inserted from the access opening side of the case.

In this case, when the cover is assembled to the case, the access opening of the case is opened by an opening operation of the cover. Then, the first end portion side of the link is connected to one of the case and the cover. Furthermore, the second end portion side of the link is connected to the connecting portion of the mounting portion. In this manner, the second fastening portion in the mounting portion to which the second end portion side of the link is connected, is fastened with respect to the first fastening portion which is provided in the other one of the case and the cover. Accordingly, the cover is assembled with respect to the case. The second fastening portion is fastened with respect to the first fastening portion by the fastening member which is inserted from the access opening side of the case. Therefore, when the second fastening portion is fastened with respect to the first fastening portion, as an opening operation of the cover with respect to the case is restricted by the link, even when the access opening of the case becomes narrower, it is possible to easily perform the fastening operation. For this reason, it becomes easy to perform the assembling operation of the cover with respect to the case.

The cover may close the access opening by a closing operation which uses a lower edge portion as a fulcrum while opening the access opening which is positioned in an upper portion of the case by an opening operation which uses the lower edge portion as a fulcrum. In this case, when the second fastening portion of the mounting portion to which the second end portion side of the link is connected is fastened with the first fastening portion, the fastening is performed by the fastening member which is inserted downwardly from the access opening side which is positioned in the upper portion of the case.

It is preferable that the first end portion side of the link is connected to one of the case and the cover, by inserting a projection portion with a flange formed in one of the case and the cover through a long hole formed on the first end portion side. In this case, a flange portion of the projection portion with the flange inserted through the long hole can be used in preventing the projection portion from falling out from the long hole.

In addition, it is preferable that, in a case where the first fastening portion is provided in the case, the connecting portion faces a wall surface formed in the same case in a state where the second fastening portion of the mounting portion is fastened with the first fastening portion.

In addition, it is preferable that, in a case where the first fastening portion is provided in the cover, the connecting portion faces a wall surface formed in the same cover in a state where the second fastening portion of the mounting portion is fastened with the first fastening portion.

It is considered that the mounting portion of the second end portion side in the link is connected to the connecting portion by inserting a convex portion formed on one of the second end portion side and the connecting portion into an engaging hole formed on the other one of the second end portion side and the connecting portion. If a connection structure of the second end portion side and the connecting portion made in this manner is employed in a structure in which the same connecting portion faces the wall surface formed in the case or the cover as described above, since the second end portion side of the link is nipped between the connecting portion and the wall surface, it is possible to prevent the convex portion from falling out from the engaging hole.

There is provided an assembling method of a cover, including: causing an access opening of a main body to be opened or closed by an opening/closing operation of the cover in which an edge portion of the cover is supported by the main body and the same edge portion is used as a fulcrum; connecting a first end portion side of a link to one of the main body and the cover in a state where the access opening is opened; connecting a second end portion side of the link to a mounting portion by inserting a convex portion into an engaging hole in a state where the access opening is opened; and fastening the mounting portion to which the second end portion side of the link is connected with respect to a fastening portion provided in the other one of the main body and the cover, by a fastening member inserted from the access opening side which is in an opened state.

In this case, when the mounting portion is fastened with the fastening portion, as an opening operation of the cover with respect to the main body is restricted by the link, even when the access opening of the main body becomes narrower, it is possible to easily perform the fastening operation. In other words, since the mounting portion can be fastened with respect to the fastening portion by the fastening member which is inserted from the access opening of the main body, it is possible to easily perform the fastening operation. For this reason, the assembling operation of the cover is easily performed.

There is provided an assembling method of a cover, including: causing an access opening of a main body to be opened and closed by an opening/closing operation of the cover in which an edge portion of the cover is supported by the main body and the same edge portion is used as a fulcrum; connecting a first end portion side of a link to one of the main body and the cover in a state where the access opening is opened; connecting a second end portion side of the link to a mounting portion which is pulled out to a position corresponding to the access opening which is in an opened state, by inserting a convex portion into an engaging hole; nipping, as the mounting portion goes back to a position before being pulled out, the second end portion side of the link between a wall surface provided in the other one of the main body and the cover and a facing surface which faces the wall surface in the mounting portion; and fastening the mounting portion to which the second end portion side of the link is connected with respect to a fastening portion provided in one of the main body and the cover where the wall surface exists, by a fastening member inserted from the access opening side which is in the opened state.

In this case, when the mounting portion is fastened with the fastening portion, as the opening operation of the cover with respect to the main body is restricted by the link, even when the access opening of the main body becomes narrower, it is possible to easily perform the fastening operation. In other words, since the mounting portion can be fastened with respect to the fastening portion by the fastening member which is inserted from the access opening side of the main body, it is possible to easily perform the fastening operation. For this reason, it is easy to perform an assembling operation of the cover.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus and an assembling method of a cover will be described with reference to FIGS. 1 to 17.

Figure 1:
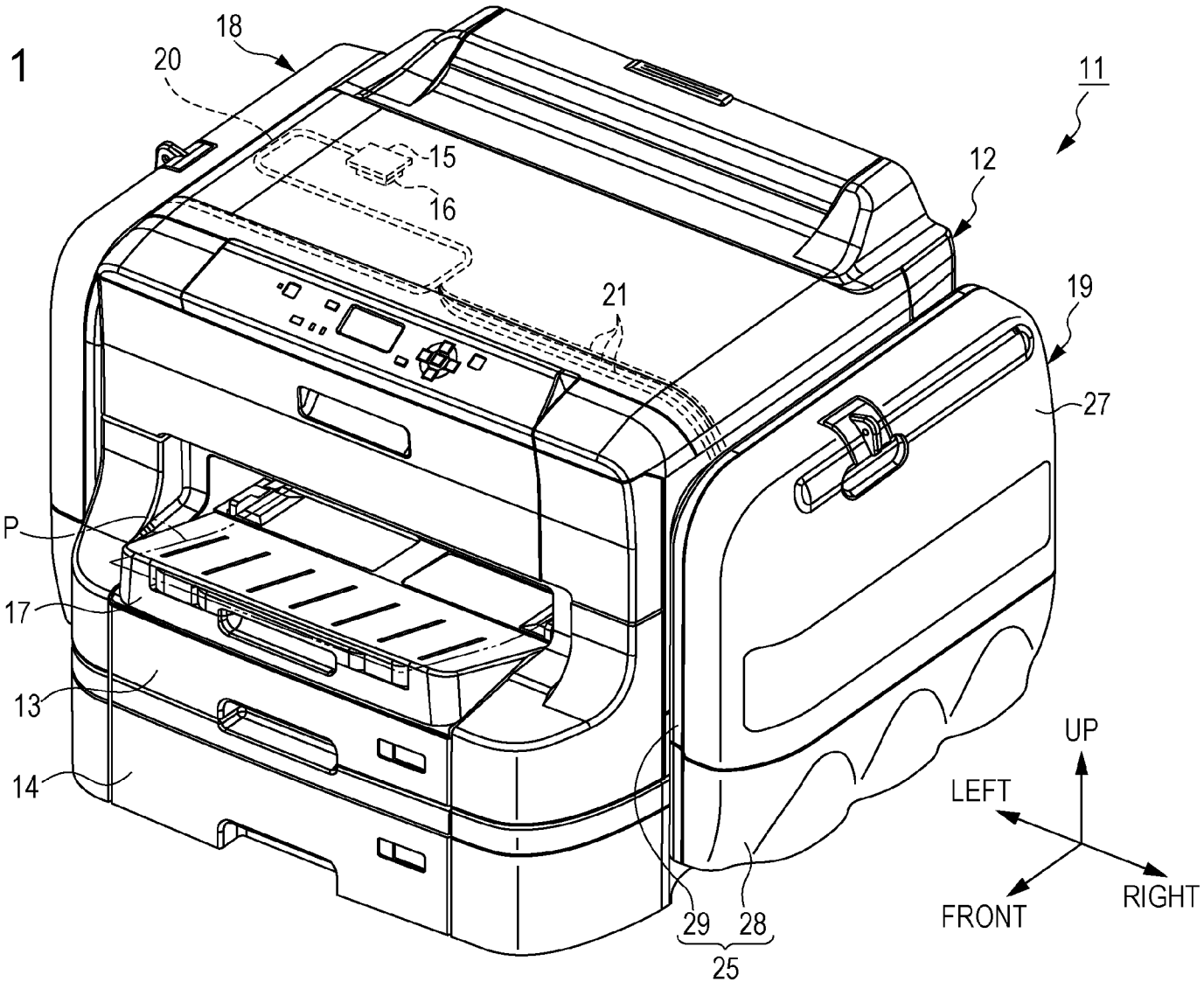
FIG. 1 is a perspective view illustrating a recording apparatus.

As illustrated in FIG. 1, paper supplying cassettes 13 and 14 of two upper and lower stages are mounted to be freely attached and detached, on a front surface of a housing 12 of a recording apparatus 11. A paper sheet P which is a medium for recording is stored in a stacked state in the paper supplying cassette 13, a paper sheet P having a size different from the above-described paper sheet P is stored in a stacked state in the paper supplying cassette 14. In addition, the paper sheet P stored in the paper supplying cassette 13 and the paper sheet P stored in the paper supplying cassette 14 may have the same size as each other.

A carriage 15 which reciprocates in a right-and-left direction is provided in the housing 12 of the recording apparatus 11. In the carriage 15, a liquid ejecting head 16 which ejects ink onto the paper sheet P transported into the housing 12 from the paper supplying cassettes 13 and 14, and performs printing, is supported. The liquid ejecting head 16 functions as a recording portion which ejects liquid (ink) with respect to a medium (paper sheet P) and performs recording (printing). The paper sheet P on which the printing is performed by the liquid ejecting head 16 is sent out to a paper discharging tray 17 which is provided on the front surface of the housing 12.

Liquid storage units 18 and 19 are provided on both right and left side surfaces of the housing 12 of the recording apparatus 11. A liquid holding body which holds black ink is stored in the liquid storage unit 18 on the left side of the housing 12, and the black ink is supplied to the liquid ejecting head 16 via an ink supplying tube 20. Meanwhile, a plurality of liquid holding bodies in which color ink is stored is stored in the liquid storage unit 19 on the right side of the housing 12, and the color ink, such as cyan ink, magenta ink, and yellow ink, which is held in every liquid holding body, is supplied to the liquid ejecting head 16 via the ink supplying tube 21.

Next, a structure of a case and a cover which cover a liquid storing body in the liquid storage units 18 and 19 will be described. In addition, a rough structure of the case and the cover in the liquid storage unit 18 and the liquid storage unit 19 is the same except for the number of the stored liquid holding bodies and the type of the ink held in the stored liquid holding bodies. For this reason, hereinafter, the structure of the case and the cover of the liquid storage unit 19 will be described in detail.

Figure 2:
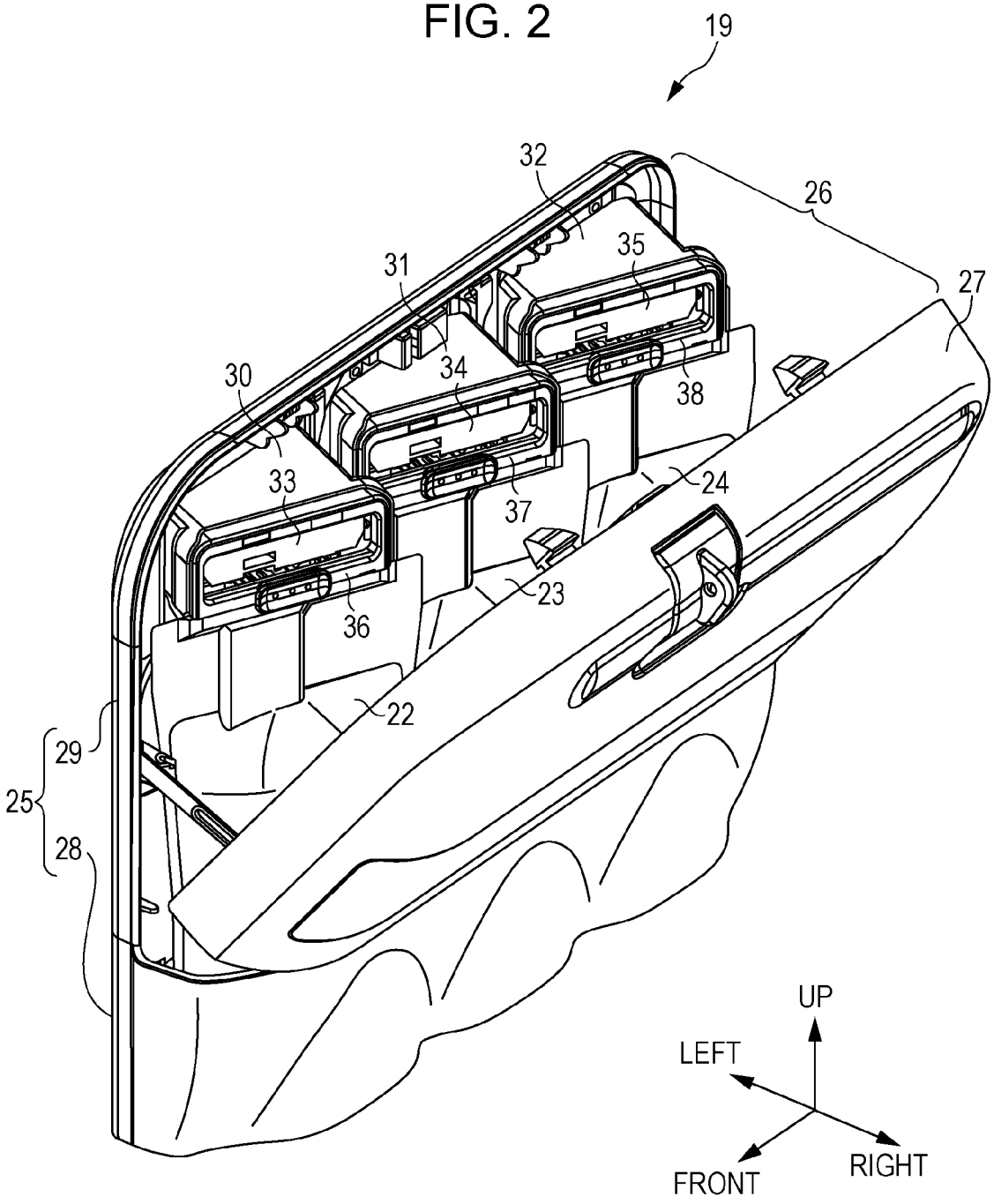
FIG. 2 is a perspective view illustrating a liquid storage unit of the same apparatus.

FIGS. 2 to 5 are perspective views illustrating the structure of the liquid storage unit 19. As illustrated in FIG. 2, the liquid storage unit 19 includes a case 25 which is attached to a side surface of the housing 12 (FIG. 1) and accommodates the liquid holding bodies 22 to 24, and a cover 27 which opens or closes an access opening 26 of the case 25 by an opening/closing operation. The case 25 includes a liquid receiving member 28 which forms a bottom portion of the same case 25, and a side wall forming member 29 which is linked to an upper end portion of a left side wall in the liquid receiving member 28 and forms the side wall on the housing 12 side of the case 25.

Figure 3:
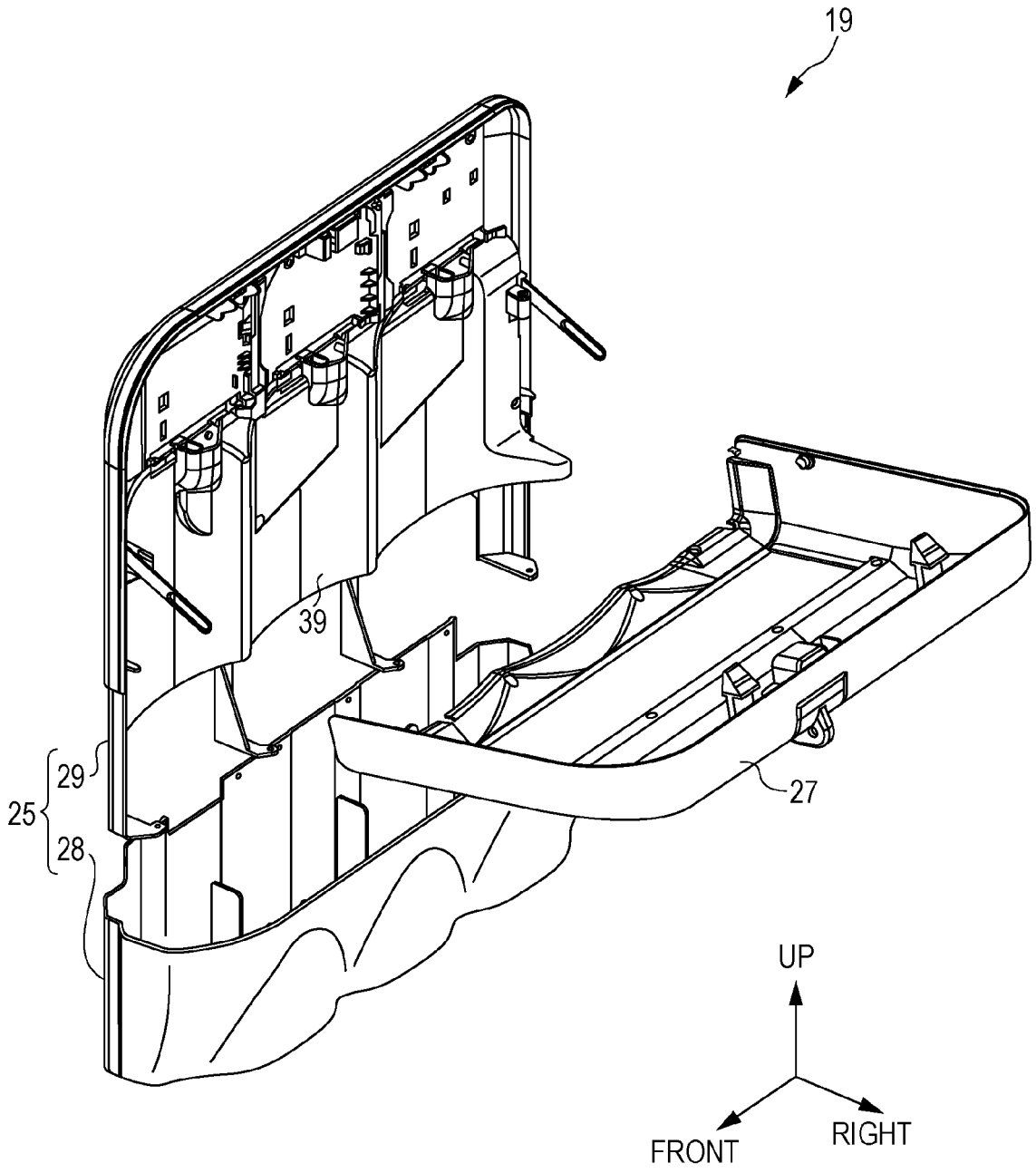
FIG. 3 is an exploded perspective view of the liquid storage unit.

FIG. 3 illustrates a state where the case 25 and the cover 27 are separated from each other, and the liquid receiving member 28 and the side wall forming member 29 of the case 25 are separated from each other. As illustrated in FIG. 3, a decorative sheet 39 is attached to a right side surface of the side wall forming member 29.

Figure 4:
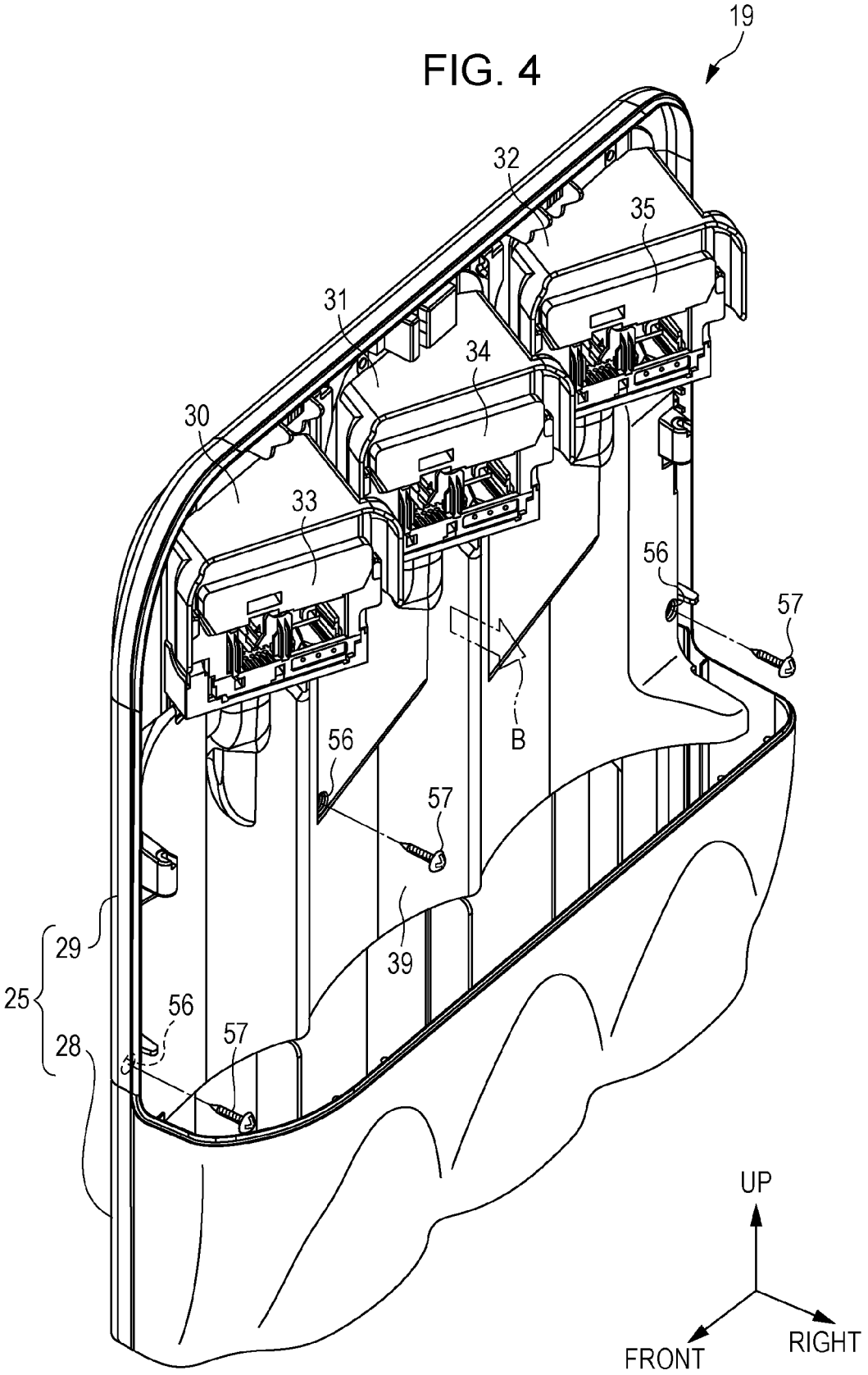
FIG. 4 is a perspective view illustrating a state where a cover is removed from a case of the same unit.

FIG. 4 illustrates a state where the side wall forming member 29 and the liquid receiving member 28 are linked to each other. The decorative sheet 39 is attached with respect to the side wall forming member 29 by respectively screwing screws 57 into a plurality of screw holes 56 formed in a lower portion of the side wall forming member 29 and the decorative sheet 39. In addition, on an upper side of the decorative sheet 39 which is on a right side surface of the side wall forming member 29, supporting members 30 to 32 are provided. In each of the sealing portions 33 to 35 which are formed to be protruded toward a front side diagonally to the supporting members 30 to 32, handle portions 36 to 38 of the liquid holding bodies 22 to 24 are sealed as illustrated in FIG. 2. Accordingly, in supporting members 30 to 32, the liquid holding bodies 22 to 24 are supported in a suspended state.

Figure 5:
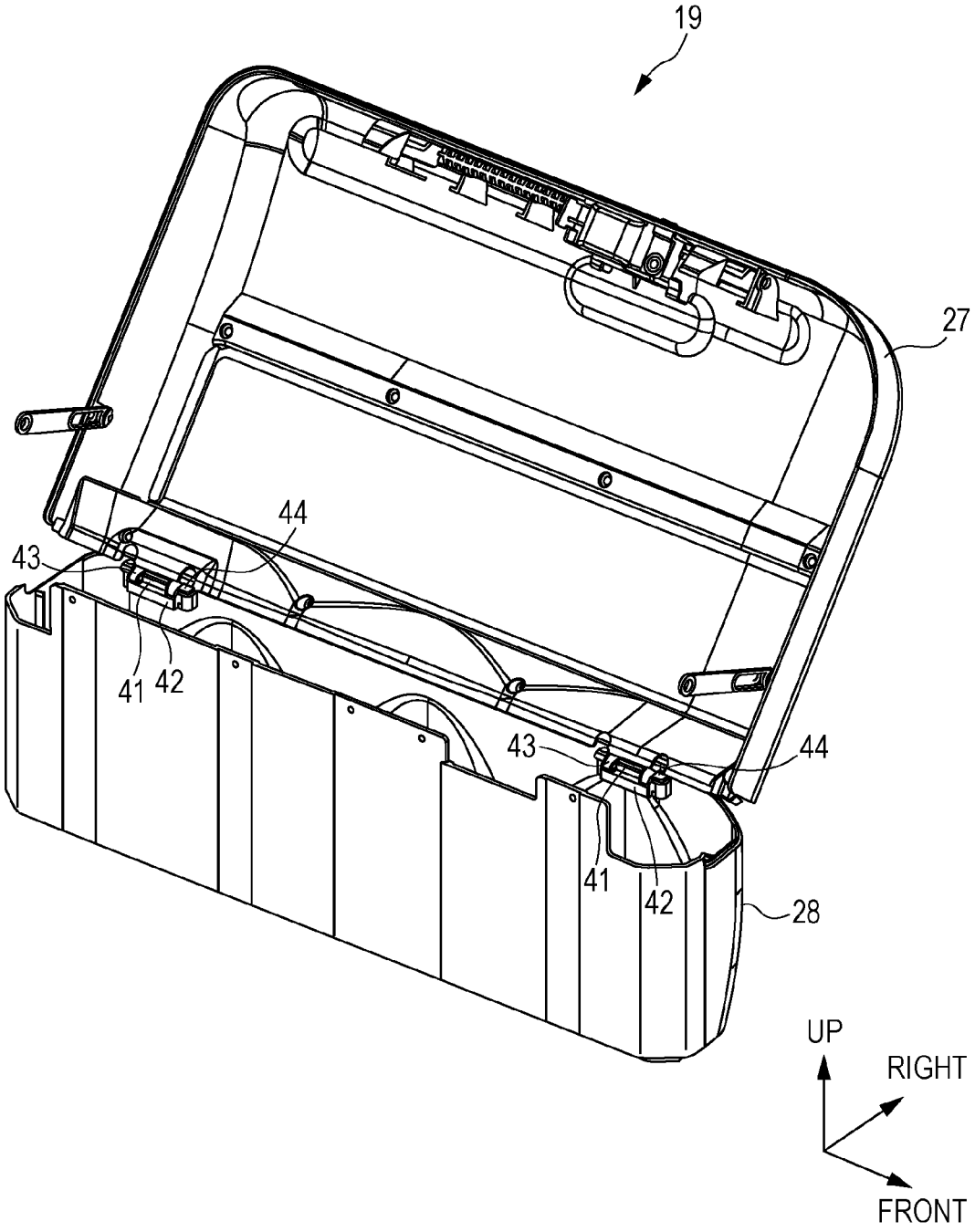
FIG. 5 is a perspective view illustrating a supporting structure of the cover with respect to a liquid receiving member of the same case.
Figure 6:
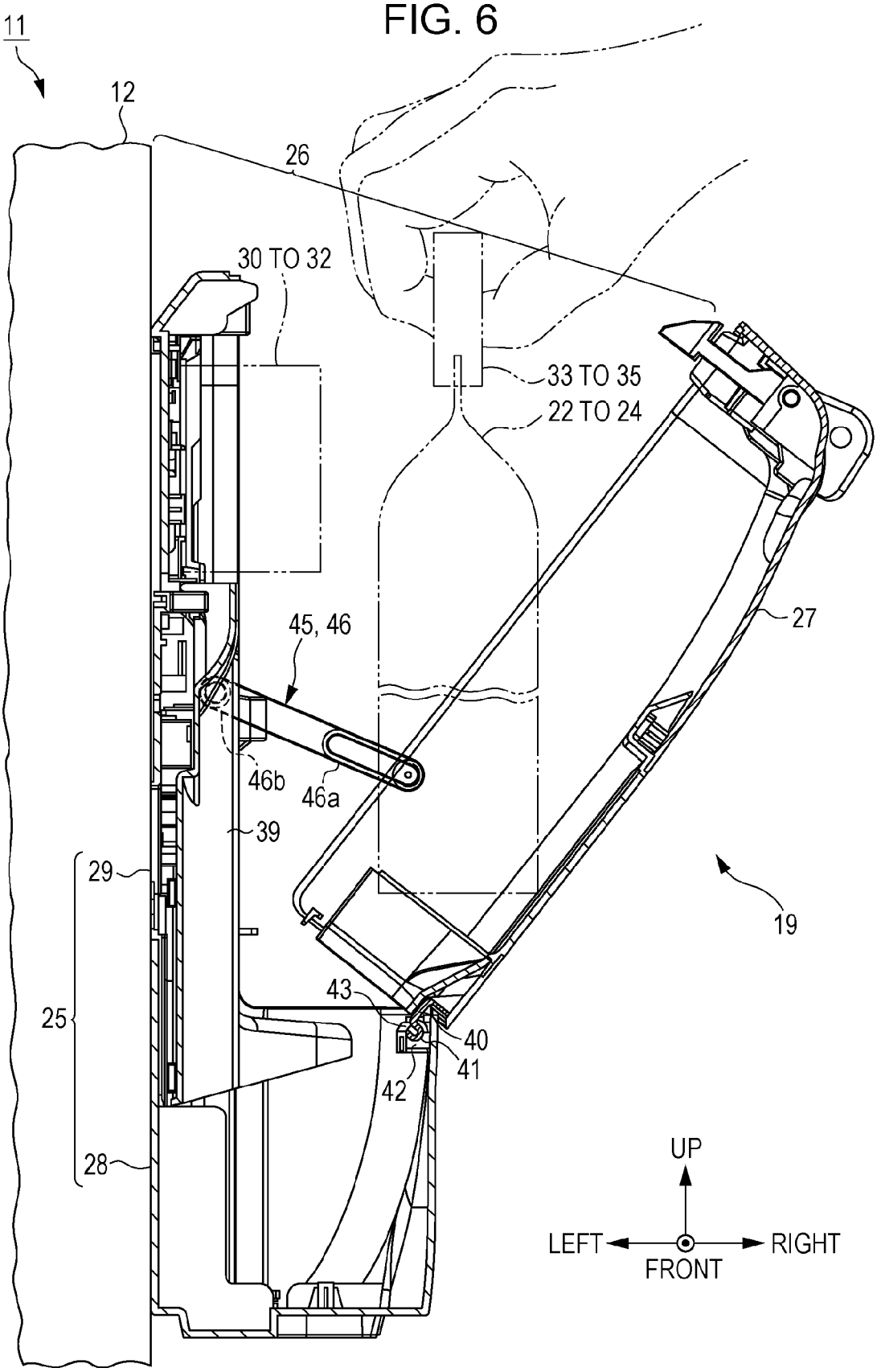
FIG. 6 is a cross-sectional view illustrating the liquid storage unit in a state where the cover is opened.

As illustrated in FIGS. 5 and 6, a lower edge portion of the cover 27 is supported in an upper end portion of a right side wall in the liquid receiving member 28. In particular, a hinge axis 41 which is fixed to the lower edge portion of the cover 27 via an arm portion 40 and extends in a front-and-rear direction, is supported to be rotatable by a bearing portion 42 which is fixed to the upper end portion of the right side wall in the liquid receiving member 28. As a holding member 43 is fixed to the bearing portion 42 by a screw 44 (FIG. 5) from above the hinge axis 41 which is supported on the bearing portion 42, the hinge axis 41 is not shifted from the bearing portion 42.

The cover 27 opens or closes the access opening 26 which is positioned in an upper portion of the case 25 as illustrated in FIG. 2, by a rotationally moving operation around the hinge axis 41, that is, by the opening/closing operation which uses the hinge axis 41 as a fulcrum. The liquid holding bodies 22 to 24 are put in and out with respect to the case 25 via the access opening 26 in a state where the access opening 26 of the case 25 is opened by the opening operation of the cover 27 as illustrated in FIG. 6.

Between the case 25 (side wall forming member 29) and the cover 27, a link mechanism 45, which allows the opening operation of the cover 27 to a certain level and restricts the same cover 27 not to be opened too much, is provided so that the same cover 27 does not bump into an object in the periphery and does not become an obstacle when the cover 27 is opened. The link mechanisms 45 are respectively provided on front and rear sides (near and far sides in a direction which is perpendicular to a paper surface in FIG. 6) between the side wall forming member 29 and the cover 27.

Next, the link mechanism 45 will be described.

As illustrated in FIG. 6, the link mechanism 45 is provided with a link 46 which links the case 25 and the cover 27 to each other. A part which is close to a first end 46*a* (right end in the drawing) of the link 46 is connected to the cover 27, and a part which is close to a second end 46*b* (left end in the drawing) of the same link 46 is connected to the decorative sheet 39. In addition, the decorative sheet 39 functions as a mounting portion which is mounted in the case 25. As the decorative sheet 39 is assembled to be fastened with the side wall forming member 29 of the case 25, the case 25 and the cover 27 are linked to each other by the link 46 of the link mechanism 45. In this state, by the link mechanism 45, the opening operation of the cover 27 is allowed to a certain level, and is restricted so that the cover 27 is not opened too much.

Figure 7:
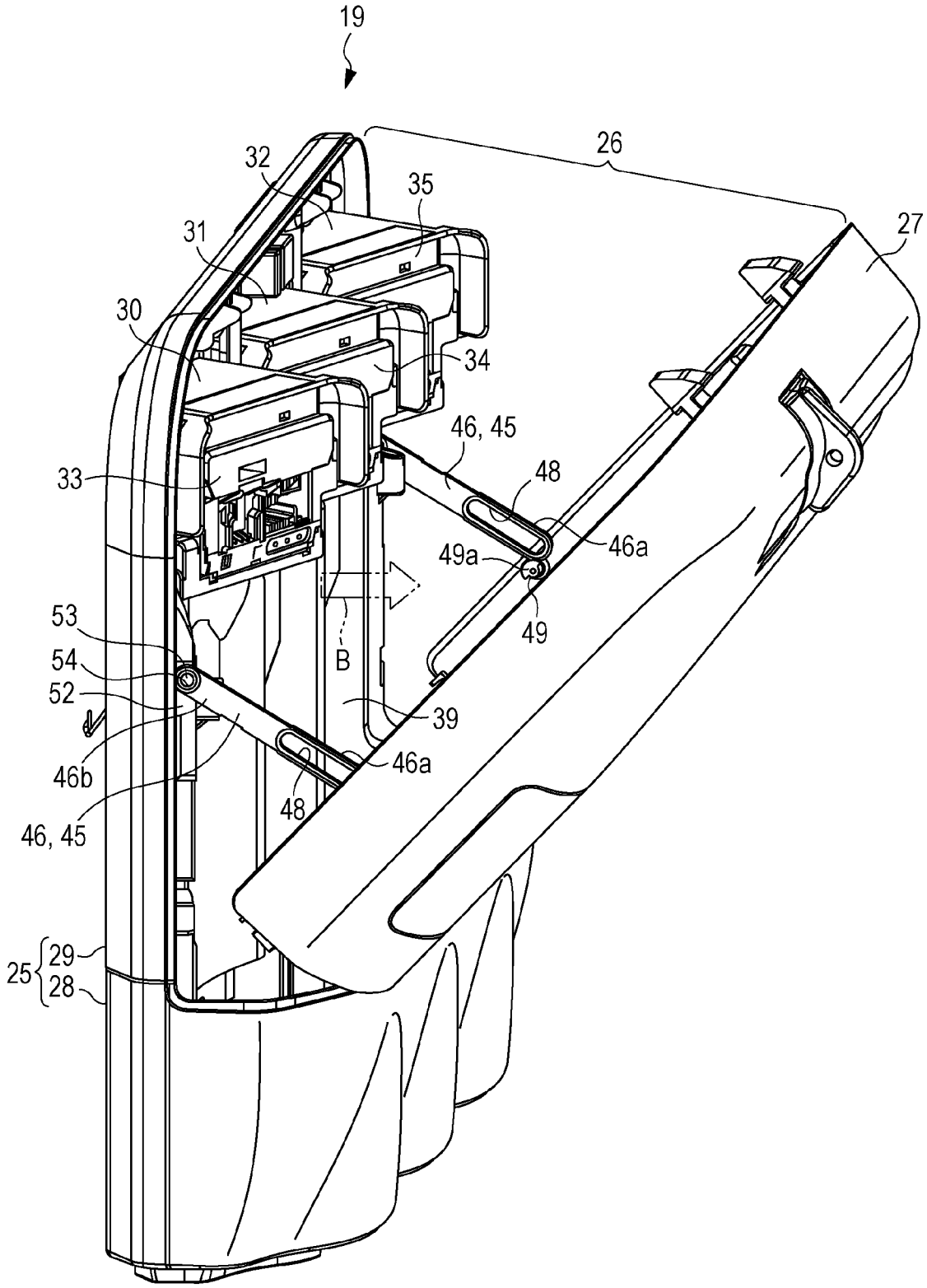
FIG. 7 is a perspective view illustrating a link mechanism of the same unit.
Figure 8:
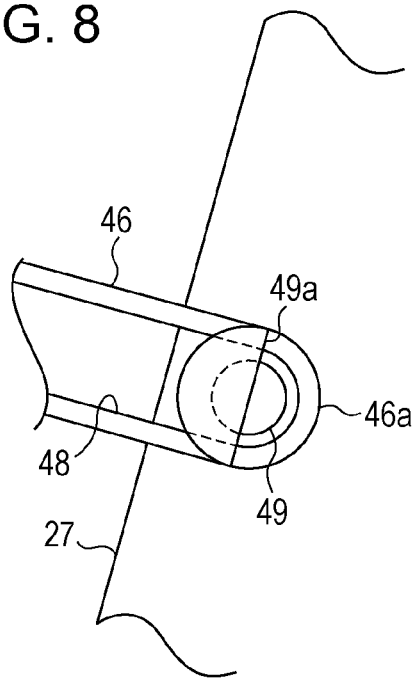
FIG. 8 is a schematic view illustrating an enlarged connecting part between a part which is close to a first end of a link and the cover.

FIGS. 7 to 9 illustrate a structure of a connecting part between the part which is close to the first end 46*a* of the link 46 and the cover 27, and a connected state of the part which is close to the first end 46*a* and the cover 27. As illustrated in FIG. 7, in the part which is close to the first end 46*a* of the link 46, a long hole 48 which considers a longitudinal direction of the link 46 as a long diameter is formed. Meanwhile, in the cover 27, a projection portion 49 with a flange 49*a* which is in a state of being protruded in a horizontal direction and inserted through the long hole 48 is formed. As illustrated in FIG. 8, the flange 49*a* is formed in a semicircular plate shape which is protruded in a radial direction of the projection portion 49 from a tip end of the projection portion 49, and is positioned in a circumferential direction of the projection portion 49 so that a width of the cover 27 in an opening/closing direction (approximately right-and-left direction in the drawing) becomes minimized.

Figure 9A:
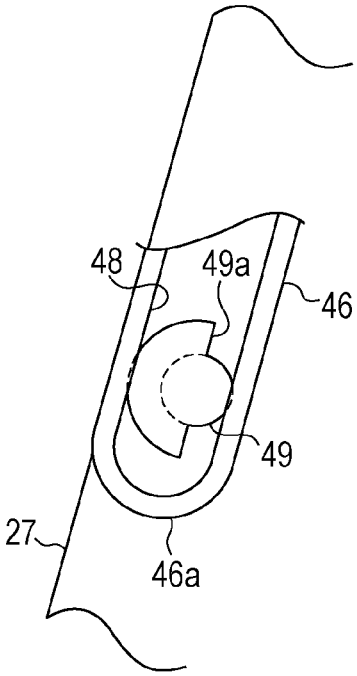
FIGS. 9A and 9B are schematic views illustrating a method of connecting the part which is close to the first end of the link and the cover.
Figure 9B:
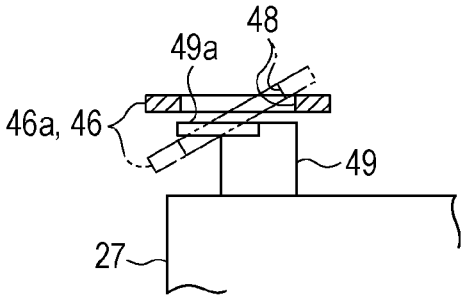

When the part which is close to the first end 46*a* of the link 46 is connected to the cover 27, as illustrated in FIG. 9A, the link 46 is aligned with respect to the projection portion 49 so that a short diameter direction (a direction which is orthogonal to a long diameter direction) of the long hole 48 and a minimum width direction (the substantial right-and-left direction in the drawing) of the projection portion 49 match each other. A relative position of the long hole 48 with respect to the projection portion 49 at this time is illustrated by a solid line in FIG. 9B. As illustrated by a two dot chain line in FIG. 9B, as the link 46 is inclined with respect to the projection portion 49, the flange 49*a* passes through the long hole 48. As a result, the projection portion 49 is in a state of being inserted through the long hole 48, and as the link 46 is rotated by approximately 90 degrees around the projection portion 49 in this state, as illustrated in FIG. 8, the link 46 is disposed so that the cover 27 extends in an opening/closing direction. In the link 46 which is disposed in this manner, the link 46 is prevented from falling out from the projection portion 49 by using the flange 49*a*. This is realized as a maximum width (a width in a substantially up-and-down direction in FIG. 8) of the flange 49*a* is set to be greater than a width of the long hole 48 in the short diameter direction.

Figure 10:
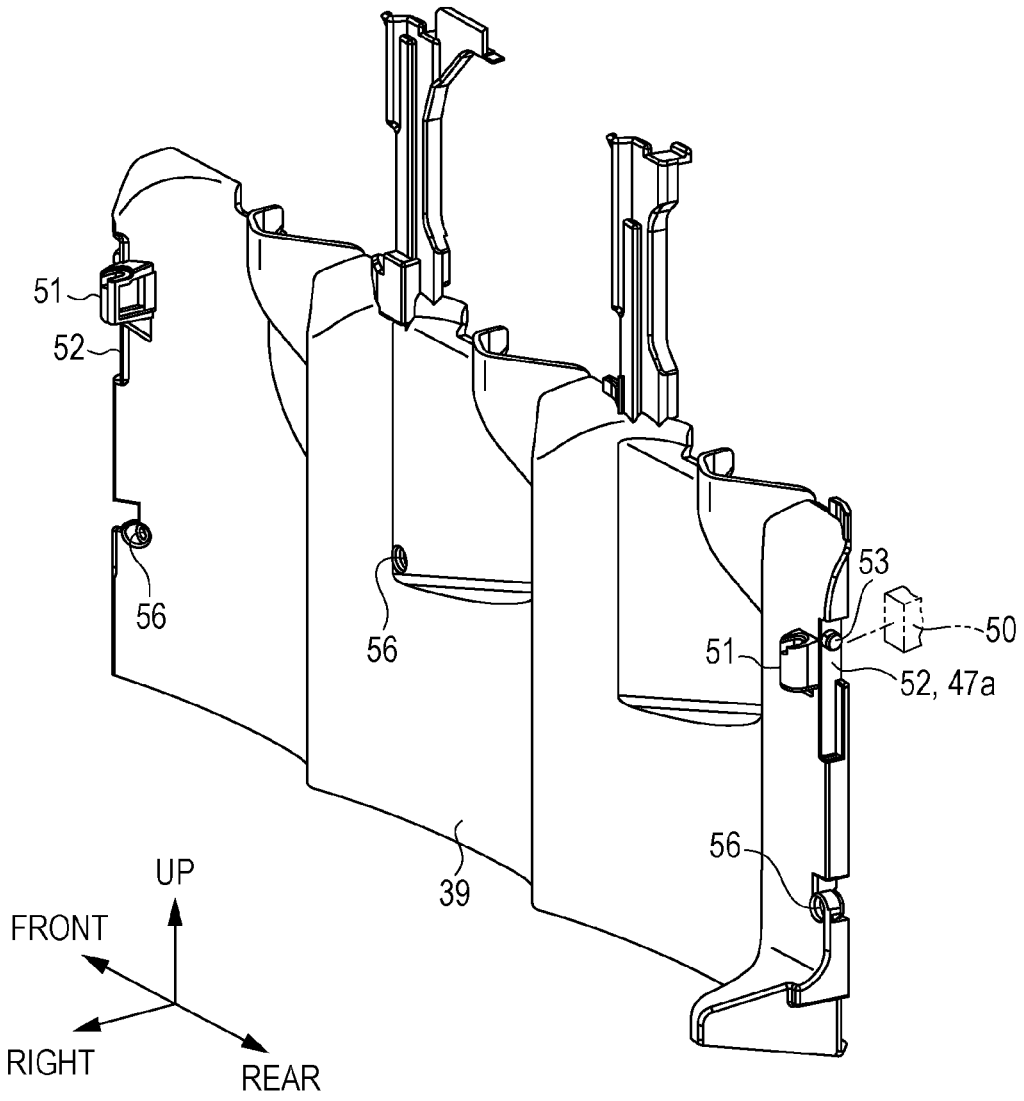
FIG. 10 is a perspective view illustrating a decorative sheet.
Figure 11:
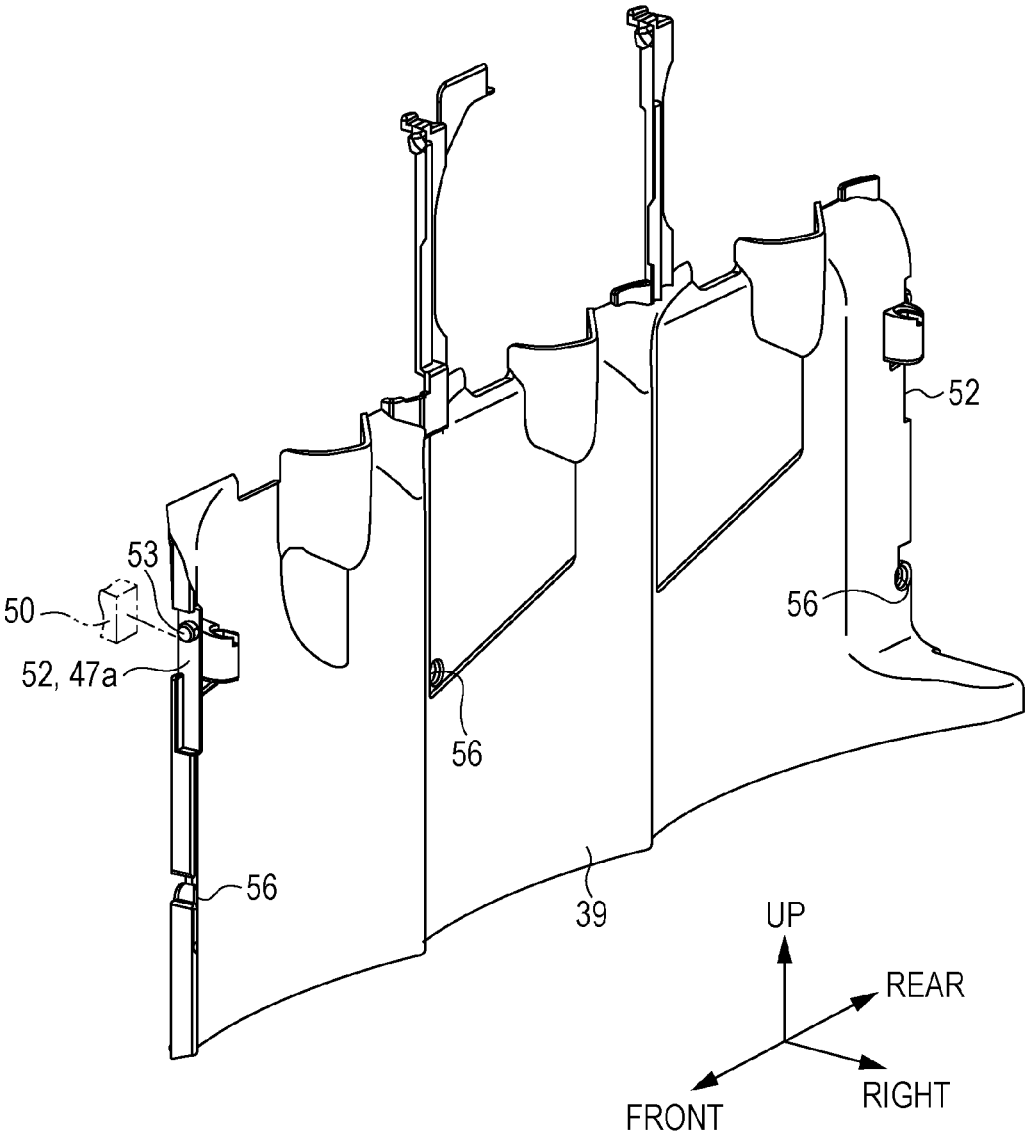
FIG. 11 is a perspective view illustrating the decorative sheet.
Figure 12:
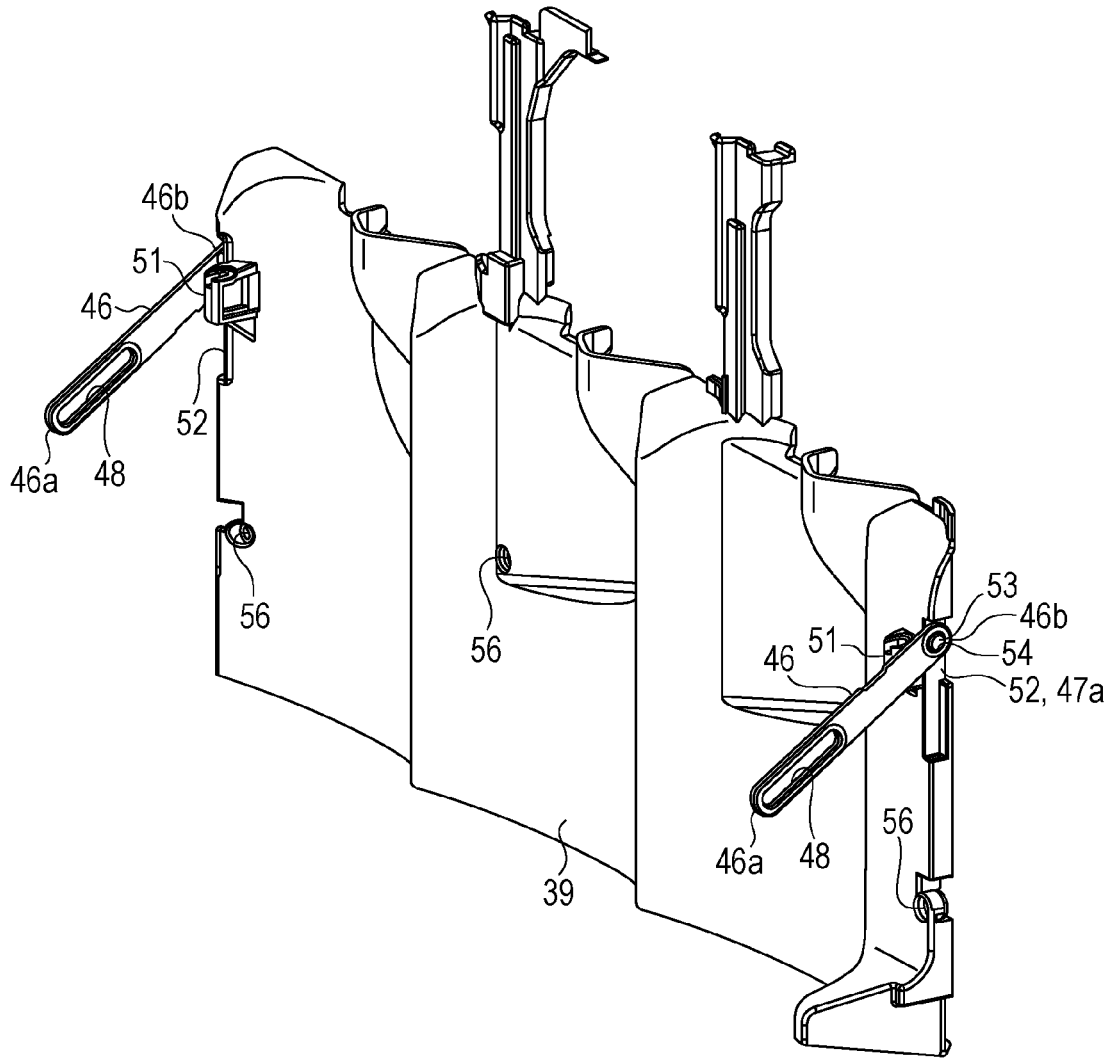
FIG. 12 is a perspective view illustrating the decorative sheet which is assembled with the link.
Figure 13:
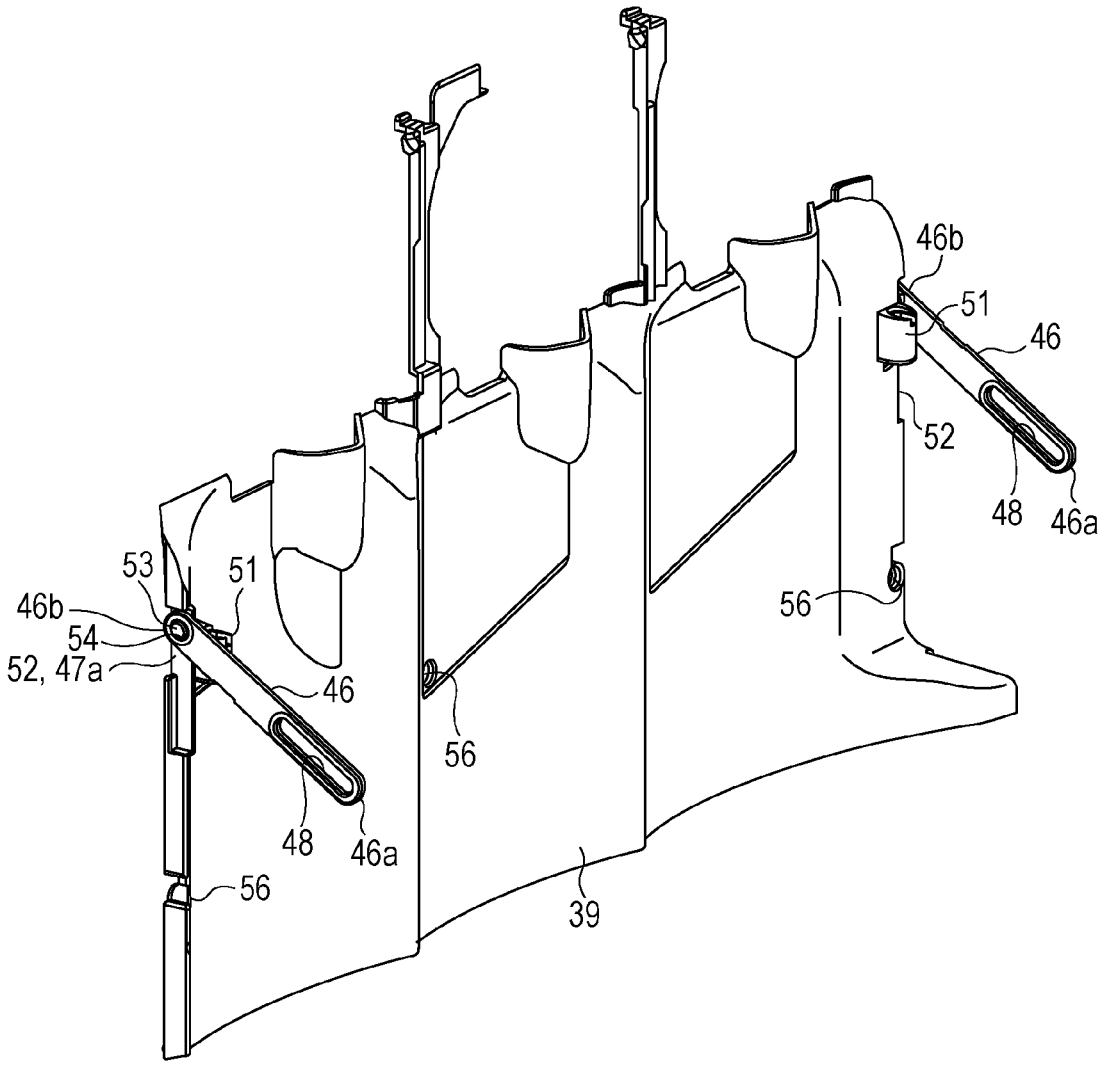
FIG. 13 is a perspective view illustrating the decorative sheet which is assembled with the link.

FIGS. 10 to 13 are perspective views illustrating the decorative sheet 39. As illustrated in FIGS. 10 and 11, in each of the front and rear edges in the decorative sheet 39, a second fastening portion 51, which is fastened with respect to a first fastening portion 50 formed to be protruded on an attachment surface of the decorative sheet 39 in the side wall forming member 29 of the case 25, is provided. In addition, in each of the front and rear edges in the decorative sheet 39, the connecting portion 52, to which the part which is close to the second end 46*b* of the link 46 illustrated in FIGS. 12 and 13 is connected, is also provided. The connecting portion 52 and the part which is close to the second end 46*b* of the link 46 are connected to each other by inserting a convex portion 53 formed in one of the connecting portion 52 and the part which is close to the second end 46*b* into an engaging hole 54 formed on the other one of the connecting portion 52 and the part which is close to the second end 46*b*. In addition, in this example, the convex portion 53 is formed to be protruded in the horizontal direction in the connecting portion 52, and the engaging hole 54 is formed at the part which is close to the second end 46*b* of the link 46. By inserting the convex portion 53 into the engaging hole 54, in a state where the part which is close to the second end 46*b* of the link 46 is connected to the connecting portion 52, the link 46 is rotatable around the convex portion 53.

Figure 14:
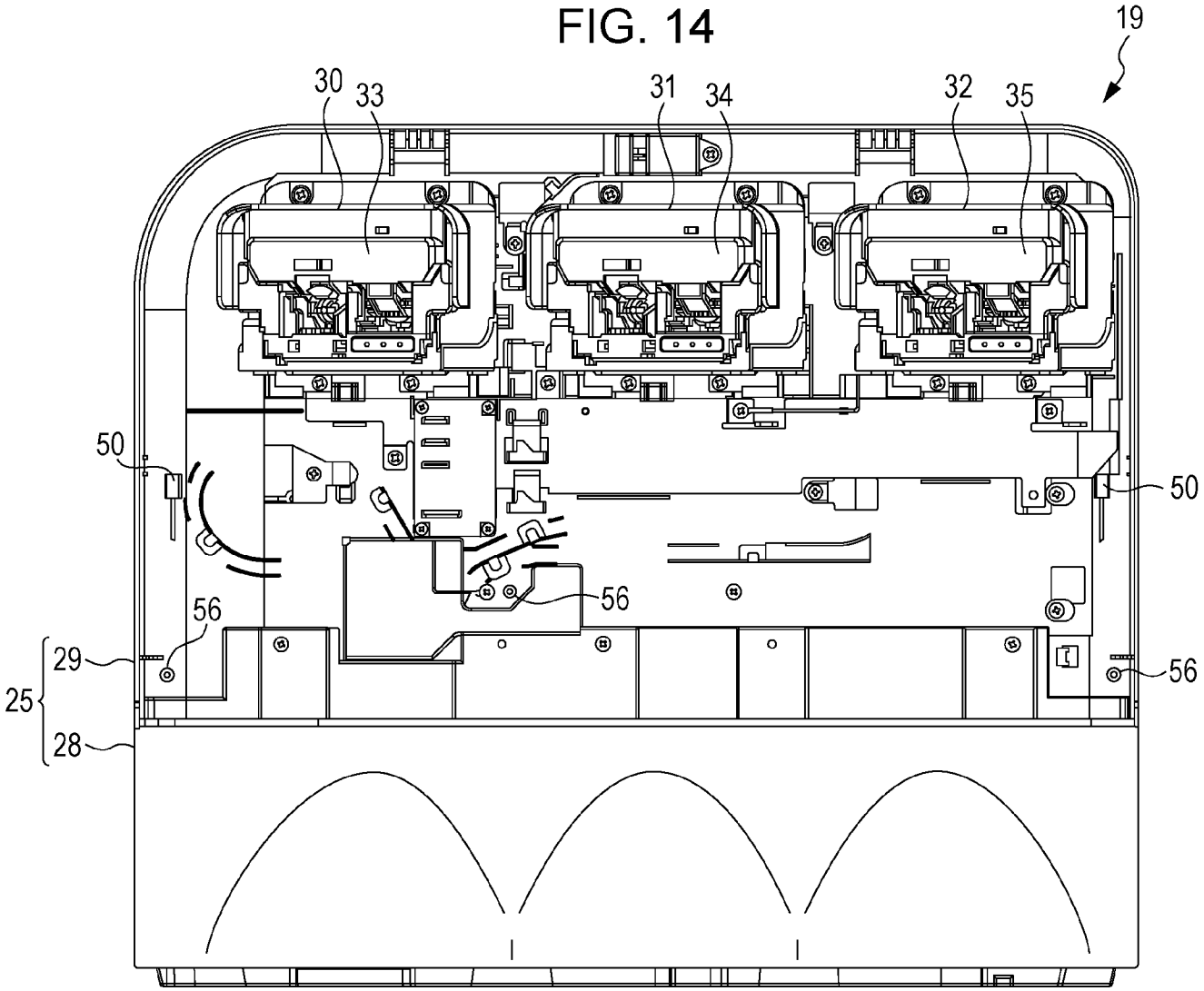
FIG. 14 is a side view illustrating a state where the case of FIG. 2 is viewed from a right side.
Figure 15:
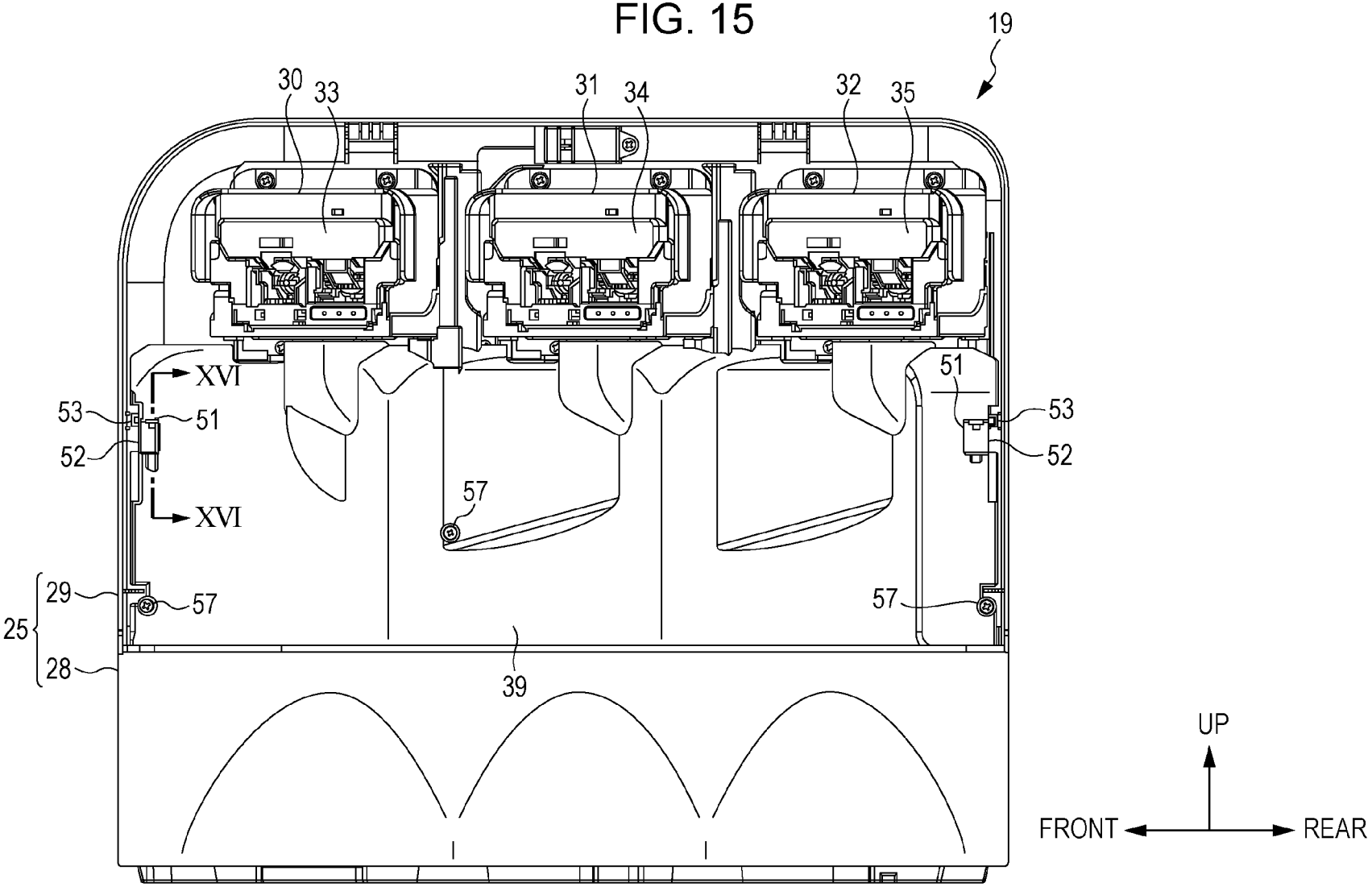
FIG. 15 is a side view illustrating a state where the case of FIG. 2 is viewed from a right side.

FIGS. 14 and 15 illustrate a state where the case 25 in FIG. 2 is viewed from a right side. In addition, FIG. 14 illustrates a state where the decorative sheet 39 is detached from the side wall forming member 29 of the case 25. FIG. 15 illustrates a state where the decorative sheet 39 is attached to the side wall forming member 29. As can be known from FIGS. 14 and 15, in a state where the decorative sheet 39 is detached from the side wall forming member 29, the first fastening portion 50 is exposed to the attachment surface of the decorative sheet 39 in the side wall forming member 29, and the second fastening portion 51 is overlapped with the first fastening portion 50 when the decorative sheet 39 is attached to the attachment surface.

Figure 16:
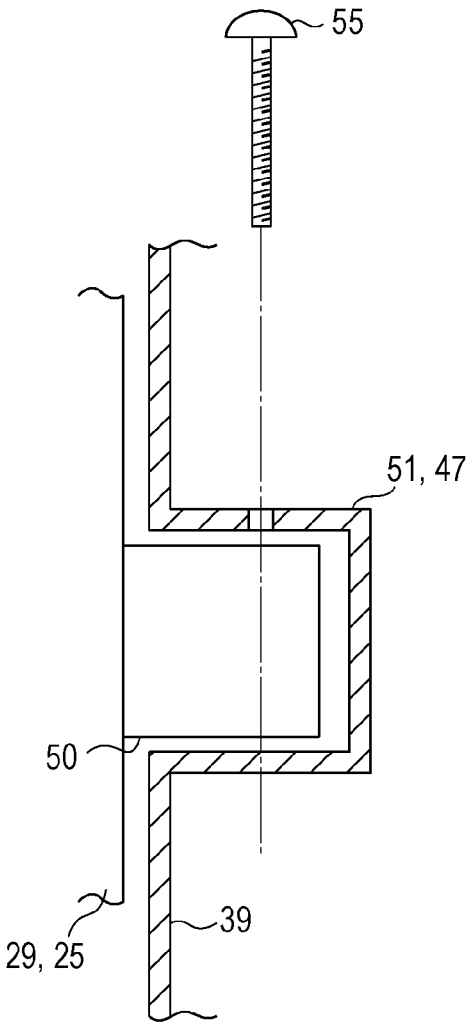
FIG. 16 is a schematic view illustrating a positional relationship between a first fastening portion and a second fastening portion when the decorative sheet is attached to a side wall forming member.

FIG. 16 is a schematic view illustrating a positional relationship between the first fastening portion 50 and the second fastening portion 51 at this time. FIG. 16 schematically illustrates a state where the periphery of the second fastening portion 51 is viewed from an arrow XVI-XVI direction in the side wall forming member 29 and the decorative sheet 39 illustrated in FIG. 15. As can be known from FIG. 16, the first fastening portion 50 is positioned on an inner side of the second fastening portion 51, and the second fastening portion 51 and the first fastening portion 50 are fastened with each other by a fastening member 55, such as a screw, in this state. The fastening member 55 is inserted into the same case 25 from the access opening 26 (refer to FIG. 6 or the like) which is positioned in the upper portion of the case 25, and is screwed downwardly with respect to the second fastening portion 51 and the first fastening portion 50. Accordingly, the decorative sheet 39 is mounted in the case 25 (side wall forming member 29). At this time, as illustrated in FIG. 6, the case 25 and the cover 27 are linked to each other by the link 46 of the link mechanism 45.

Figure 17:
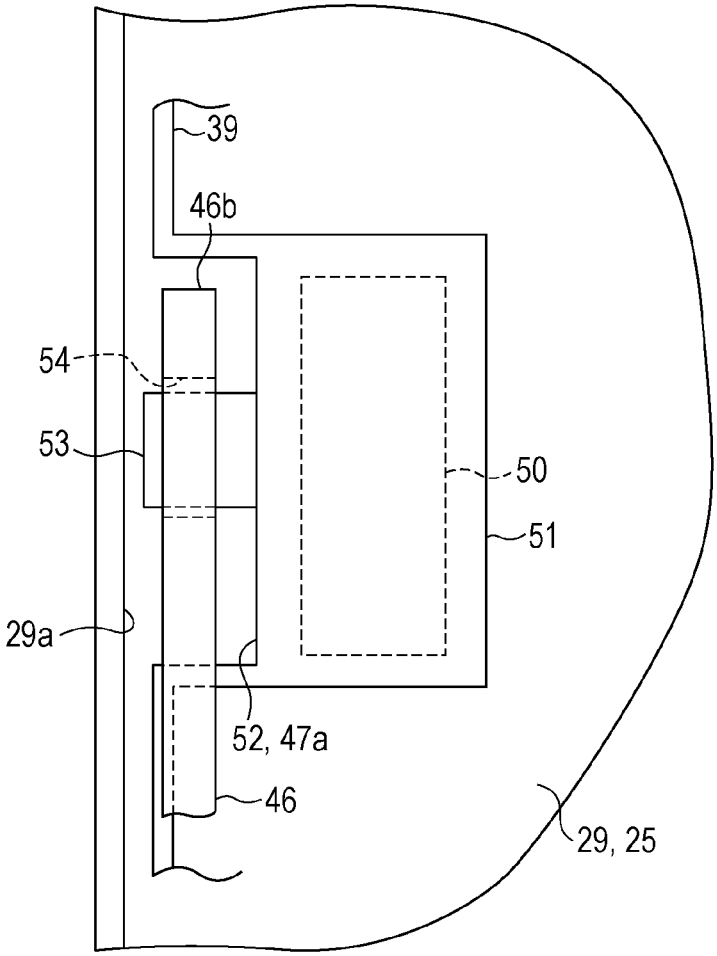
FIG. 17 is a schematic view illustrating a position of a second end of the link when the second fastening portion of the decorative sheet is fastened with the first fastening portion of the side wall forming member.

FIG. 17 is a schematic view illustrating a state where the second end 46*b* of the link 46 is connected to the connecting portion 52 of the decorative sheet 39, and a position of the second end 46*b* when the second fastening portion 51 of the decorative sheet 39 is fastened with the first fastening portion 50 of the side wall forming member 29. FIG. 17 schematically illustrates a state where the first fastening portion 50 of the side wall forming member 29 and the second fastening portion 51 of the decorative sheet 39 illustrated in FIG. 16 are viewed from a right side (right side surface side) of FIG. 17. As can be known from FIG. 17, at this time, a facing surface 47*a* which is formed in the connecting portion 52 faces a wall surface 29*a* in the side wall forming member 29. The second end 46*b* of the link 46 is nipped between the wall surface 29*a* and the facing surface 47*a*. Therefore, after the second fastening portion 51 is fastened with the first fastening portion 50 in this manner, the convex portion 53 of the connecting portion 52 is prevented from falling out from the engaging hole 54 of the second end 46*b*.

Next, an assembling method of the cover 27 with respect to the main body (in this example, the case 25) will be described.

When the cover 27 is assembled to the case 25, first, as illustrated in FIG. 4, the decorative sheet 39 is attached to the side wall forming member 29 of the case 25 by screwing the screws 57 into each screw hole 56. In this state, it is possible to pull out the upper portion of the decorative sheet 39 in a right direction (arrow B direction) with respect to the side wall forming member 29. After this, as illustrated in FIG. 5, the hinge axis 41 which is provided in the lower edge portion of the cover 27 is supported to be rotatable on the bearing portion 42 of the case 25 (liquid receiving member 28). Accordingly, the cover 27 can perform the opening/closing operation by using the hinge axis 41 as a fulcrum. Furthermore, as the holding member 43 is fixed to the same bearing portion 42 by the screw 44 from above the hinge axis 41 which is supported on the bearing portion 42, the hinge axis 41 is not shifted from the bearing portion 42.

After this, as illustrated in FIG. 7, the access opening 26 is opened by the opening operation of the cover 27 which uses the hinge axis 41 as a fulcrum. While the part which is close to the first end 46*a* of the link 46 is connected to the cover 27, the part which is close to the second end 46*b* of the link 46 is connected to the connecting portion 52 of the decorative sheet 39. At this time, the decorative sheet 39 which is attached to the side wall forming member 29 is pulled out from the side wall forming member 29 side in the arrow B direction so that the second fastening portion 51 is positioned in accordance with the access opening 26. The part which is close to the second end 46*b* of the link 46 is connected to the connecting portion 52 of the decorative sheet 39 by inserting the convex portion 53 into the engaging hole 54.

After the part which is close to the second end 46*b* of the link 46 is connected to the connecting portion 52 of the decorative sheet 39, as the decorative sheet 39 goes back to a position before being pulled out in the arrow B direction, the part which is close to the second end 46*b* of the link 46 is nipped between the wall surface 29*a* of the side wall forming member 29 (case 25) and the facing surface 47*a* of the connecting portion 52 as illustrated in FIG. 17. Furthermore, at this time, as illustrated in FIG. 16, the first fastening portion 50 of the side wall forming member 29 is positioned on an inner side of the second fastening portion 51 of the decorative sheet 39. The second fastening portion 51 and the first fastening portion 50 are fastened with each other by the fastening member 55, such as the screw, which is inserted downwardly from the access opening 26 (FIG. 7) or the like. Accordingly, the cover 27 is assembled to the case 25.

Next, an operation of the recording apparatus 11 and the assembling method of the cover 27 will be described.

The second fastening portion 51 of the decorative sheet 39 is fastened with respect to the first fastening portion 50 of the case 25 (side wall forming member 29) by the fastening member 55 which is inserted downwardly from the access opening 26 side which is positioned in the upper portion of the case 25. Therefore, when the second fastening portion 51 is fastened with respect to the first fastening portion 50, as the opening operation of the cover 27 with respect to the case 25 is restricted by the link 46, even when the access opening 26 of the case 25 becomes narrower, it is possible to easily perform the fastening operation. For this reason, it is easy to perform the assembling operation of the cover 27 with respect to the case 25.

According to the above-described embodiment, effects illustrated hereinafter are obtained.

(1) The second fastening portion 51 is fastened with respect to the first fastening portion 50 for assembling the cover 27 to the case 25 by the fastening member 55 which is inserted from the access opening 26 side. Therefore, even when the opening operation of the cover 27 is restricted by the link 46 and the access opening 26 becomes narrower, since it is possible to easily perform the fastening operation, it is easy to perform the assembling operation of the cover 27 with respect to the case 25.

(2) The part which is close to the first end 46*a* of the link 46 is connected to the same cover 27 as the projection portion 49 with the flange 49*a* provided in the cover 27 is inserted through the long hole 48 formed in this part. In this case, by using the flange 49*a* part of the projection portion 49 which is inserted through the long hole 48, it is possible to prevent the projection portion 49 from falling out from the long hole 48.

(3) The part which is close to the second end 46*b* of the link 46 is connected to the connecting portion 52 of the decorative sheet 39 by inserting the convex portion 53 which is provided in the other one of the part which is close to the second end 46*b* and the connecting portion 52 to the engaging hole 54 which is provided in one of the part which is close to the second end 46*b* and the connecting portion 52. When the second fastening portion 51 of the decorative sheet 39 is fastened with the first fastening portion 50 of the case 25 (side wall forming member 29), the part which is close to the second end 46*b* of the link 46 is nipped between the wall surface 29*a* of the side wall forming member 29 and the facing surface 47*a* of the decorative sheet 39 (connecting portion 52). For this reason, in a state where the second fastening portion 51 is fastened with the first fastening portion 50, it is possible to prevent the convex portion 53 from falling out from the engaging hole 54.

In addition, in the above-described embodiment, for example, it is possible to change as follows.

In the assembling method of the cover 27, before the second fastening portion 51 of the decorative sheet 39 is fastened with the first fastening portion 50 of the side wall forming member 29, in order to attach the decorative sheet 39 to the side wall forming member 29, and to connect the part which is close to the second end 46*b* of the link 46 to the connecting portion 52 of the decorative sheet 39, it is not essential to pull out the decorative sheet 39 in the arrow B direction in FIG. 7. For example, in a state where the decorative sheet 39 is not attached to the side wall forming member 29, the part which is close to the second end 46*b* of the link 46 is connected to the connecting portion 52, and after this, the decorative sheet 39 is aligned with respect to the side wall forming member 29. Specifically, the decorative sheet 39 is aligned with respect to the side wall forming member 29 so that the first fastening portion 50 of the side wall forming member 29 is positioned on the inner side of the second fastening portion 51 of the decorative sheet 39. In this state, as the second fastening portion 51 and the first fastening portion 50 are fastened with each other by the fastening member 55, without pulling out the decorative sheet 39 from the side wall forming member 29 side as described above, or going back to the position before being pulled out, the second fastening portion 51 may be fastened with the first fastening portion 50.

The positional relationship between the engaging hole 54 and the convex portion 53 for connecting the part which is close to the second end 46*b* of the link 46 to the connecting portion 52 of the decorative sheet 39, can be reversed. In other words, the engaging hole 54 can be formed in the connecting portion 52, and the convex portion 53 can be formed at the part which is close to the second end 46*b* of the link 46.

Instead of making the decorative sheet 39 function as the mounting portion, the mounting portion can be provided as a body which is separated from the decorative sheet 39. In this case, the decorative sheet 39 is assembled to the side wall forming member 29 separately from the mounting portion. Meanwhile, the mounting portion is fixed with respect to the side wall forming member 29 as the second fastening portion 51 of the mounting portion is fastened with respect to the first fastening portion 50 of the side wall forming member 29 by the fastening member 55.

In the projection portion 49 with the flange 49*a* which is used in connecting the part which is close to the first end 46*a* of the link 46 to the cover 27, a shape of the flange 49*a* is not necessarily a semicircular plate shape, and can be a shape other than the semicircular shape.

The mounting portion provided with the connecting portion which connects the part which is close to the first end 46*a* in the link 46 to the side wall forming member 29 of the case 25 and to which the part which is close to the second end 46*b* in the link 46 is connected, may be fastened with the cover 27. In this case, as the second fastening portion provided in the above-described mounting portion is fastened with the first fastening portion provided in the cover 27, the same mounting portion is mounted in the cover 27. In addition, it is preferable that the part which is close to the second end 46*b* of the link 46 is nipped between the wall surface formed in the cover 27 and the facing surface which faces the wall surface in the mounting portion in a state where the second fastening portion is fastened with the first fastening portion.

The access opening 26 of the case 25 is not necessarily provided in the upper portion of the case 25. For example, as the opening/closing operation of the cover 27 is performed by using a lateral edge of the same cover 27 as a fulcrum, the access opening 26 which is opened or closed by the opening/closing operation of the case 25 may be set in a side portion of the case 25. In this case, the first fastening portion and the second fastening portion are fastened with each other by the fastening member, such as the screw, which is inserted into the case 25 in the substantially horizontal direction from the access opening.

The assembling method of the cover is not limited to assembling the cover 27 of the liquid storage unit 19, and may be employed in other covers in the recording apparatus 11. Examples of such covers include a cover of the housing 12 in the recording apparatus 11, a cover of a reversing path, or a cover of an interface, including a memory card or a USB memory.

In addition, in an off-carriage type recording apparatus which supplies the ink of an ink cartridge which is set in the housing 12 with respect to the carriage that supports a liquid ejecting head, it is also possible to employ the assembling method in a cover which is opened and closed when putting in and out the ink cartridge. Furthermore, in the off-carriage type recording apparatus which sets the ink cartridge in the carriage that supports the liquid ejecting head, it is possible to employ the assembling method in a cover of the carriage unit.

If the recording apparatus is provided with a scanner unit, the assembling method may also be employed in a cover of the scanner unit. In addition, when an auto-document feeder (ADF) is provided in the scanner unit, it is possible to employ the assembling method in a cover of the ADF, and in a cover of a mounting stand of the medium transported to the same ADF.

The recording apparatus 11 is not limited to an apparatus which performs printing on the paper sheet P, and may be an apparatus which performs recording on the medium, such as a piece of cloth, a plastic film, or a CD.

The entire disclosure of Japanese Patent Application No.: 2014-051450, filed Mar. 14, 2014 is expressly incorporated by reference herein.

What is claimed is:

1. A recording apparatus, comprising:

a case which is provided on a side surface of a housing, the case configured to accommodate a liquid holding body;

a recording portion which is provided in the housing, the recording portion being configured to ejects liquid supplied from the liquid holding body onto a medium;

a cover configured to open or close an access opening of the case;

a link having a first end portion side and a second end portion side on a side opposite to the first end portion side, the first end portion side being connected to one of the case and the cover;

a first fastening portion provided in the other one of the case and the cover; and a mounting portion having a connecting portion which is connected to the second end portion side, and a second fastening portion which is fastened to the first fastening portion, the second fastening portion being mounted in the other one of the case and the cover, wherein the mounting portion is mounted with respect to the other one of the case and the cover by fastening the first fastening portion and the second fastening portion by a fastening member inserted from the access opening side of the case.

2. The recording apparatus according to claim 1, wherein a lower edge portion of the cover is a fulcrum during opening and closing of the access opening which is positioned in an upper portion of the case.

3. The recording apparatus according to claim 2, wherein the first end portion side is connected to one of the case and the cover by inserting a projection portion into a flange formed in one of the case and the cover through a long hole formed on the same first end portion side.

4. The recording apparatus according to claim 1, wherein the first fastening portion is provided in the case, and wherein the connecting portion faces a wall surface formed in the case in a state where the second fastening portion of the mounting portion is fastened with the first fastening portion.

5. The recording apparatus, according to claim 1, wherein the first fastening portion is provided in the cover, and wherein the connecting portion faces a wall surface formed in the cover in a state where the second fastening portion of the mounting portion is fastened with the first fastening portion.

6. An assembling method of a cover, comprising:

causing an access opening of a main body to be opened or closed by an opening/closing operation of the cover in which an edge portion of the cover is supported by the main body and the same edge portion is used as a fulcrum;

connecting a first end portion side of a link to one of the main body and the cover in a state where the access opening is opened;

connecting a second end portion side of the link to a mounting portion by inserting a convex portion into an engaging hole in a state where the access opening is opened; and in an opened state of the access opening, fastening the mounting portion, to which the second end portion side of the link is connected, with respect to a fastening portion provided in the other one of the main body and the cover by inserting a fastening member from the access opening side.

7. An assembling method of a cover, comprising:

causing an access opening of a main body to be opened and closed by an opening/closing operation of the cover in which an edge portion of the cover is supported by the main body and the same edge portion is used as a fulcrum;

connecting a first end portion side of a link to one of the main body and the cover in a state where the access opening is opened;

in an opened state of the access opening, connecting a second end portion side of the link to a mounting portion, which is pulled out to a position corresponding to the access opening, by inserting a convex portion into an engaging hole;

nipping, as the mounting portion goes back to a position before being pulled out, the second end portion side of the link between a wall surface provided in the other one of the main body and the cover and a facing surface which faces the wall surface in the mounting portion; and in the opened state of the access opening, fastening the mounting portion, to which the second end portion side of the link is connected with respect to a fastening portion provided in one of the main body and the cover where the wall surface exists, by inserting a fastening member from the access opening side.

* * * * *